United States Patent [19]

Childs et al.

[11] Patent Number: 4,484,876

[45] Date of Patent: Nov. 27, 1984

[54] APPARATUS FOR CONTINUOUS FRICTION-ACTUATED EXTRUSION

[75] Inventors: John B. Childs, London; Norman R. Fairey, Carshalton, both of England

[73] Assignee: BICC Public Limited Company, London, England

[21] Appl. No.: 495,986

[22] Filed: May 19, 1983

Related U.S. Application Data

[62] Division of Ser. No. 232,410, Feb. 6, 1981, Pat. No. 4,397,622.

[30] Foreign Application Priority Data

Feb. 19, 1980 [GB] United Kingdom ..... 8005498

[51] Int. Cl.[3] ..... B22F 3/02; B21C 23/01

[52] U.S. Cl. ..... 425/79; 72/262; 419/67; 425/224; 425/374

[58] Field of Search ..... 72/262, 268; 419/41, 419/67; 425/78, 79, 224, 374

[56] References Cited

U.S. PATENT DOCUMENTS

| | | | |
|---|---|---|---|
| 3,765,216 | 10/1973 | Green | 425/224 |
| 3,872,703 | 3/1975 | Green | 72/262 |
| 4,041,745 | 8/1977 | Moreau | 425/224 |
| 4,044,587 | 8/1977 | Green et al. | 425/374 |
| 4,055,979 | 11/1977 | Hunter et al. | 72/262 |
| 4,101,253 | 7/1978 | Etherington | 425/79 |
| 4,217,852 | 8/1980 | Nagai et al. | 72/262 |
| 4,362,485 | 12/1982 | Slater et al. | 425/79 |

FOREIGN PATENT DOCUMENTS

| | | | |
|---|---|---|---|
| 1370894 | 10/1974 | United Kingdom . | |
| 1504890 | 3/1978 | United Kingdom . | |
| 1507303 | 4/1978 | United Kingdom . | |
| 1535004 | 12/1978 | United Kingdom . | |
| 2020582A | 11/1979 | United Kingdom . | |
| 2023440A | 1/1980 | United Kingdom . | |
| 2028206 | 3/1980 | United Kingdom . | |
| 1566152 | 4/1980 | United Kingdom . | |
| 1574604 | 10/1980 | United Kingdom . | |
| 1590776 | 6/1981 | United Kingdom . | |
| 2069389 | 8/1981 | United Kingdom . | |
| 2087301 | 5/1982 | United Kingdom | 425/78 |
| 2089703 | 6/1982 | United Kingdom . | |

OTHER PUBLICATIONS

"Improvements Relating to Continuous Extrusion Apparatus", PCT International Publication WO83/00452, Feb. 17, 1983.

Research Disclosure, No. 203, Mar. 1981, (Havant, Hampshire, GB), disclosure No. 20342, "Recent developments in 'Conform'-continuous extrusion technology", p. 137, right-hand column, lines 61-65.

*Primary Examiner*—Jay H. Woo

*Assistant Examiner*—Tinker R. McBrayer

*Attorney, Agent, or Firm*—Buell, Blenko, Ziesenheim & Beck

[57] ABSTRACT

In a modified "Conform" machine for continuous friction-actuated extrusion of metals, especially particulate copper, the abutment at the outlet end of the working passageway does not fully block the end of the wheel groove. Instead a substantial clearance is left, and metal extruding through it adheres to the wheel to re-enter the working passageway at the entry end. Preferably the abutment is of semicircular cross-section. For a given output rate, a significant reduction in torque, and working stresses, is obtained.

4 Claims, 13 Drawing Figures

APPARATUS FOR CONTINUOUS FRICTION-ACTUATED EXTRUSION

This application is a divisional of our copending application, Ser. No. 232,410, filed Feb. 6, 1981, now U.S. Pat. No. 4,397,622.

This invention relates to the continuous extrusion of metals to produce wires, strips and other elongate bodies of considerable length.

In British Patent Specification No. 1370894 (United Kingdom Atomic Energy Authority) there is described a process, now known in the metal fabricating industry as the Conform process, comprising the steps of feeding metal into one end of a passageway formed between first and second members with the second member having a greater surface area for engaging the material than the first member, said passageway having a block end remote from said one end and having at least one die orifice associated with said blocked end, and moving the passageway defining surface of the second member relative to the passageway defining surface of the first member in a direction towards the die orifice from said one end to said blocked end such that the frictional drag of the passageway defining surface of the second member draws the material substantially in its entirety through the passageway and through the die orifice.

In the usual practical application of the Conform process, the passageway has been arcuate, the second member has been a wheel with a groove formed in its surface into which the first member projected, and the blocked end has been defined by an abutment projecting from the first member and (apart from inevitable clearances) substantially filling the groove.

It was quickly appreciated that the metal need not be fed in the form of a rod but could be in particulate form.

In the case of copper, our main interest has been in particulate feeds because extrusion from rod feed by the Conform process is not considered competitive with conventional drawing processes.

Particulate copper has been extruded by the Conform process on an experimental scale, but the forces generated in the machinery in doing so have been at the limits of material and design technology and even with high-grade research personnel it has proved difficult to maintain satisfactory extrusion conditions for more than an hour or so, whereas the process cannot be considered ripe for commercial exploitation until it will run without interruption under the supervison of a shopfloor production worker for at least an 8-hour shift.

We have now discovered that the effort required to effect extrusion, at least with a particulate feed, can be very substantially reduced by a simple but very significant modification to the process, and that in the case when particulate copper is being processed a very considerable improvement in reliability and continuity of operation results.

In accordance with one aspect of the invention, a continuous friction-actuated extrusion process comprising forming a passageway extending from an entry end to an exit end between an arcuate first member and a second member in the form of a wheel having a circumferential groove formed in its peripheral surface into which groove the first member projects while rotating the wheel in such a direction that those surface of the passageway constituted by the groove travel from the entry end towards the exit end, feeding metal (preferably particulate metal) into the passageway at the entry end and extruding it from the passageway through at least one die orifice located in or adjacent to an abutment member extending across the passageway at the exit end thereof is characterised by the facts that the abutment member (instead of being large enough to block the end of the passageway) is of substantially smaller cross-section than the passageway and leaves a substantial gap between the abutment member and the groove surface and that the metal is allowed to adhere to the groove surface, whereby a substantial proportion of the metal (as distinct from the inevitable leakage of flash through a working clearance) extrudes through the clearance and that this metal remains as a lining in the groove to re-enter the passageway at the entry end while the remainder of the metal extrudes through the die orifice(s).

In accordance with another aspect of the invention, continuous friction-actuated extrusion apparatus comprising a passageway extending from an entry end to an exit end between an arcuate first member and a second member in the form of a wheel having a circumferential groove formed in its peripheral surface into which groove the first member projects, means for rotating the wheel in such a direction that those surfaces of the passageway constituted by the groove travel from the entry end towards the exit end, and at least one die orifice located in or adjacent to an abutment member extending across the passageway at the exit end thereof for extrusion of material from the passageway is characterised by the fact that the abutment member (instead of being large enough to block the end of the passageway) is of substantially smaller cross-section than the passageway and leaves a substantial gap between the abutment member and the groove surface through which a substantial proportion of the metal will extrude in use to remain as a lining in the groove to re-enter the passageway at the entry end.

In general, no special precautions are needed to secure adequate adhesion of the metal to the groove surface, but for some metals careful choice of wheel and tooling materials and dimensions may be necessary.

Preferably, in order to promote adhesion of the material to the groove surface and minimise the extrusion effort, the abutment member has a cross-section with a peripheral length (in contact with the material extruding from the passageway) substantially less than the peripheral length of the effective groove cross-section, and preferably the abutment member is smoothly curved. For a number of reasons, discussed later, we very much prefer to use an abutment with a semicircular or otherwise rounded end in a square or approximately square groove, but if required the cross-sectional periphery of the groove could be further increased by inserting subordinate grooves, ribs, or other formations, in the base and/or the lower sidewalls (if distinguishable) of the main groove.

As indicated above, the use of an abutment that is semicircular in cross-section has a number of major advantages when used in a square or approximately square groove.

Firstly, the ratio of the peripheral length of the abutment to its cross-sectional area is minimised, which tends to reduce the proportion of total energy expended in shearing of the metal flowing round the abutment.

Secondly, it has been found that this combination of shapes achieves a considerable reduction in torque requirement, over and above other shapes of equal clearance, for a given output rate. This surprising result can in part be explained by approximate calculations based on consideration of the longitudinal force equilibrium in a system with a rectangular abutment of width 2a and height 2b.

Noting the equilibrium of elastic and plastic stresses, and utilising well-known stress/strain relations, it is possible to derive a generalised Laplace equation which estimates the displacement of the metal at any point in the region adjoining the face of the abutment. Solution of this equation with appropriate boundary conditions leads to the formula $$U(x, y, z) = \frac{-Ky^2}{2a\beta^2} + \frac{Ka}{6\beta^2} - \frac{2Ka}{\pi^2\beta^2} \sum_{n=1}^{\infty} \frac{(-1)^{n+1}}{n^2} e^{\frac{n\pi\gamma x}{a}} \cdot \cos\frac{n\pi y}{a} + \frac{Kz}{\beta^2} - \frac{8Kb}{\pi^2\beta^2} \sum_{n\ \mathrm{odd}} \frac{(-1)^{\frac{n-1}{2}}}{n^2} e^{\frac{n\pi\gamma x}{2b}} \operatorname{Sin}\frac{n\pi z}{2b} - \frac{Kx^2}{2a\beta^2} + Cx$$

where U (x,y,z) is the displacement at a point with coordinates x (measured normally from the abutment face), y (measured transversely from the centreline of the abutment) and z (measured radially from the centre of the abutment: $\beta$ and $\gamma$ are constants characteristic of the elastic and plastic properties of the particular metal being extruded; K is the shear stress at the boundaries of the abutment, and C is a constant representing boundary conditions.

By noting that the pressure adjacent to the extrusion orifice must be equal to the characteristic extrusion pressure of the metal, $p_e$, and neglecting the small difference in pressure between the orifice and the mid-point of the base of the abutment, it follows tha the pressure p (y,z) on the abutment at the point with coordinates y,z will approximate to the value $$p(y, z) = p_e + \frac{2K}{\pi\gamma}\left\{ \tanh^{-1}\left(\operatorname{Sin}\frac{\pi z}{2b}\right) - \ln\left|\cos\frac{\pi y}{2a}\right|\right\}.$$

The terms inside the brackets have opposite signs, and their magnitudes increase rapidly to large values respectively as y approaches b and x approaches a. It is therefore evident that the total thrust on the abutment, $$\int_{y=-a}^{+a} \int_{x=-b}^{+b} p(y, z)\, dy \cdot dz,$$

will be usefully diminished by the elimination of that part of the area in which both y and z are simultaneously large.

Thirdly, a smoothly curved shape is desirable to avoid the stress concentrations and flow disturbances that would be introduced by any distinct corner, and a semicircular shape is not only the optimum from this viewpoint but also the simplest and most economical smoothly curved shape to manufacture.

When the metal to be extruded is susceptible to oxidation, it may be desirable to use an atmosphere of a suitable non-oxiding gas (e.g. nitrogen) to protect the material re-circulating on the wheel.

Secondar benefits of the invention are that the adherent material on the groove surface improves grip, and that the quantity of flash generated is reduced; further, when the metal is of higher thermal conductivity than the material of the wheel, thermal stresses are reduced.

The invention will be further described, by way of example, with reference to the accompanying drawings in which FIG. 1 is a fragmentary view of a conventional Conform machine, showing the abutment and die in side elevation and a portion of the wheel in cross-section;

Figure 1:
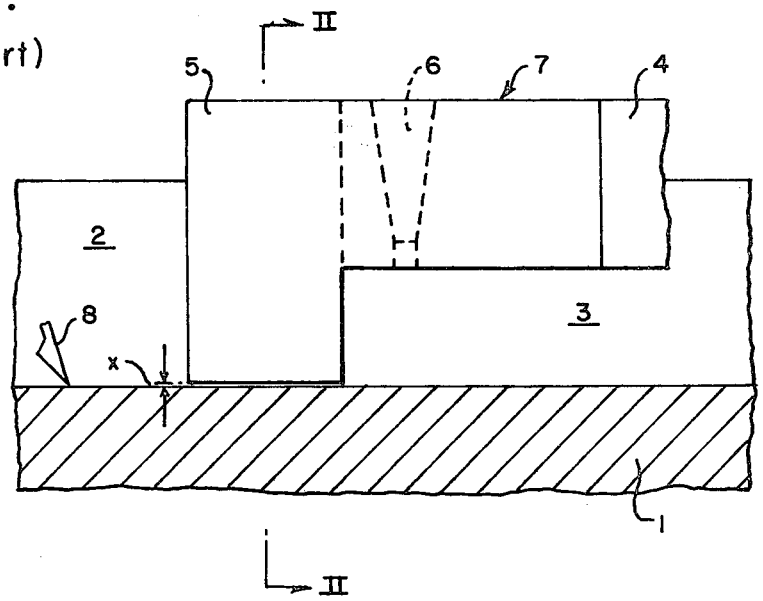
Fig. 1. (Prior Art)

In a conventional Conform machine (FIGS. 1 and 2) a wheel 1 of relatively large diameter is formed with a rectangular groove 2 that forms three sides of the extrusion passageway 3. The fourth side is formed by an assembly comprising a shoe 4 (only a small portion of which is shown), and an abutment 5.

A radial extrusion orifice 6 is formed in a die member 7 (which is preferably a separate component, though it might be integral with either the abutment or the shoe). Alternatively the die orifice may be formed tangentially through the abutment itself. The shoe, abutment and die member are of high-strength materials and are held in position by heavy-duty support members (not shown), and cooling means will usually be provided. Conventionally the clearance x has been set at the smallest value consistent with the inevitable tolerance on the wheel radius; for example in a typical machine with a rectangular wheel groove 9.6 mm wide by 14 mm deep the clearance has been specified as minimum 0.05 mm, maximum 0.25 mm. Furthermore a scraper 8 has been provided to strip from the wheel any metal flash that emerged through this small clearance so that it could not be carried around the wheel to re-enter the working passageway.

In the machine of the present invention, in direct contrast to this prior art, the clearance y (FIG. 3) is substantially greater than that required to provide mere working clearance; it will not normally to be less than 1 mm at the closest point. In the preferred form of FIGS. 3–8, the abutment 11 is semicircular as seen in FIG. 4 and (for the same wheel groove) the preferred clearance y is in the range 1.5 to 2 mm and the average spacing across the width of the abutment is around 3.7 mm. The result is that a substantial proportion of the metal extrudes through the clearance between the abutment 11 and the wheel 1 in the form of a layer 12 which adheres to the wheel and continues around it to re-enter the working passageway 3 in due course.

Figure 5:
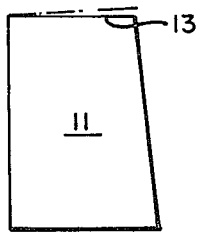
FIGS. 5 and 6 are mutually perpendicular views of the abutment.
Figure 6:
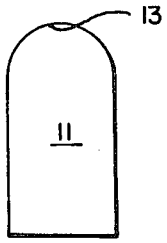

As best seen in FIG. 5, the curved surface 13 of the abutment is tapered in a longitudinal direction to minimise its area of contact with the metal being worked, consistent with adequate strength. A taper angle of two degrees is considered optimum.

Figure 7:
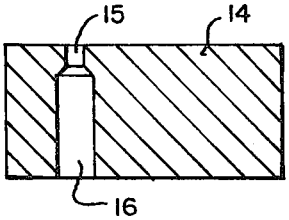
FIGS. 7 and 8 are mutually perpendicular views of a die member.
Figure 8:
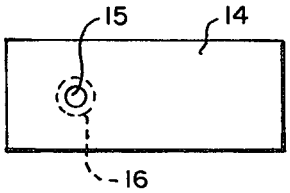

As shown in FIGS. 7 and 8, the preferred form of die member is a simple block 14 providing a die orifice 15 (which may be formed in an annular die insert), relieved by a counterbore 16 on the other side to provide a clearance around the extruded product.

Figure 9:
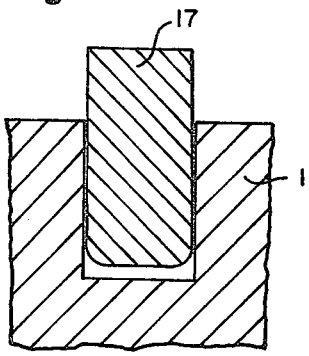
FIGS. 9–13 are views, corresponding to FIGS. 2 and 4, of alternative forms of the invention.
Figure 10:
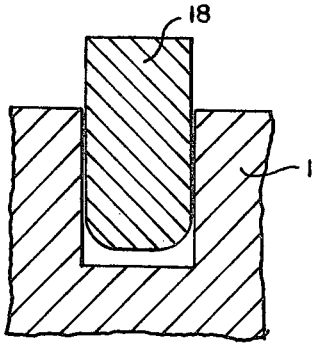
Figure 11:
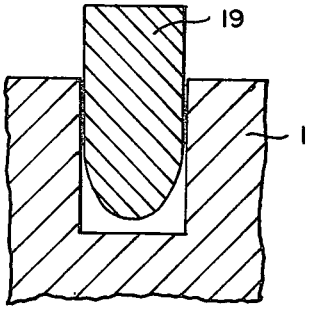
Figure 12:
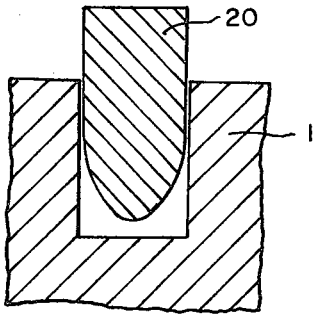

Although the semicircular cross-section of FIG. 4 is much preferred, other shapes of abutment that provide a substantial clearance can be used. Examples include those shown in the drawings as follows:

A simple rectangle, preferably with its corners radiussed as shown at 17 in FIG. 9 spaced from the base of the groove;

A heavily radiussed rectangle, as shown at 18 in FIG. 10;

A hemi-ellipse, as shown at 19 in FIG. 11;

A parabolic segment, as shown at 20 in FIG. 12; and

Figure 13:
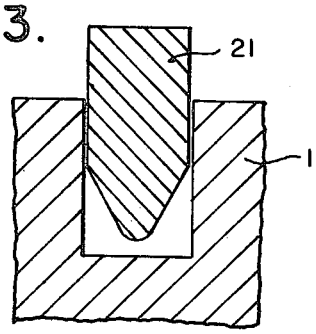

A radiussed triangle, as shown at 21 in FIG. 13.

EXAMPLE 1

Figure 2:
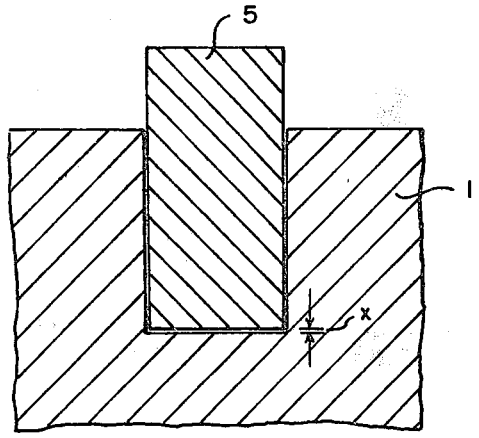
Fig. 2. (Prior Art)
FIG. 2 is a cross-section on the line II—II in FIG. 1.

A model '2D' Conform machine, as supplied by Babcock Wire Equipment Ltd., had a groove and abutment of the form shown in FIGS. 1 and 2. This model of Conform machine was designed for extrusion of aluminium and is reported to have operated satisfactorily in that role.

When the machine was fed with particulate copper (electrical conductivity grade, in the form of chopped wire, average particle size about 3 mm) at ambient temperature to form a single wire 2 mm in diameter the effort required to effect extrusion (as measured by the torque applied to maintain a wheel speed of about 5 rpm) fluctuated wildly in the region of 31–37 kNm. Out of twenty-two short experimental runs, thirteen were terminated by stalling of the motor or other breakdown within 2 minutes; the remainder were stopped after about ten minutes due to infeed limitations. After modifying the abutment to the shape shown in FIGS. 2, 3 and 4 the extrusion effort was stabilised at about 26 kNm and a continuous run of 1 hour (limited by the capacity of the take-up equipment) was readily achieved.

EXAMPLE 2

Figure 3:
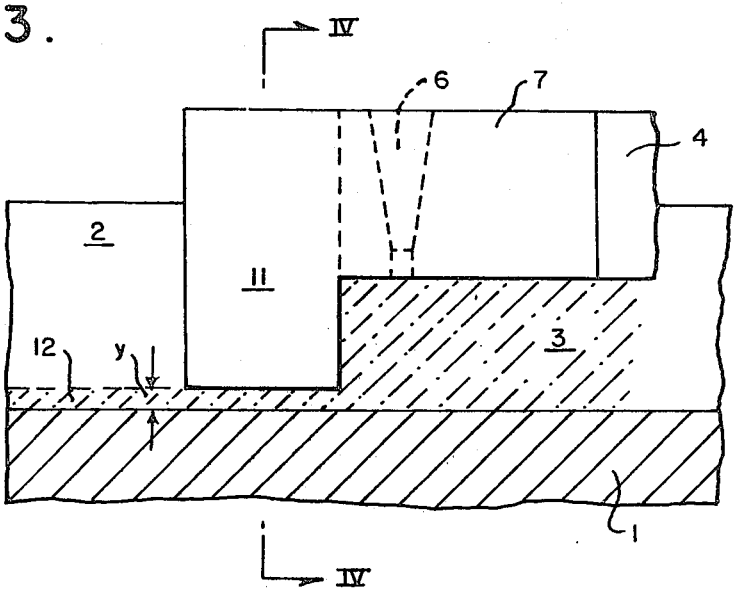
FIGS. 3 and 4 are views, corresponding to FIGS. 1 and 2 respectively, of a preferred form of apparatus in accordance with the present invention.
Figure 4:
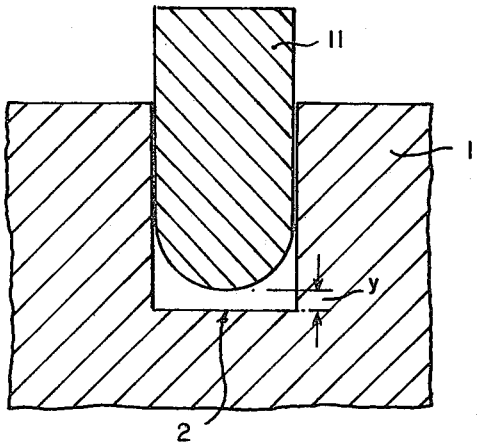

In a stricter comparison test, the same machine as used in Example 1 was operated with four different abutments:

(i) a conventional, blocking, rectangular abutment;

(ii) a rectangular abutment of smaller height, leaving a uniform clearance of about 1.1 mm (as FIG. 9 but with a much smaller corner radius);

(iii) the preferred semicircular abutment of FIGS. 2–3; and (iv) an abutment approximating to the ellipse of FIG. 11.

The machine was fed with the same chopped copper granules through a hopper which was kept full enough for the wheel speed to control the output rate, and the wheel speed was adjusted to whatever value was required to achieve an output of 2 m/s of 2 mm-diameter wire.

The following table gives essential dimensions of the abutment and indicates the speed, torque and power required to achieve the specified output with the various abutments:

| Abutment | (i) | (ii) | (iii) | (iv) |
|---|---|---|---|---|
| Area ($mm^2$) | 72.8 | 63.1 | 62 | 47 |
| Periphery (mm) | 24.1 | 22.7 | 21.0 | 18.5 |
| Wheel speed (revolutions per minute) | 9.5 | 10.3 | 10.2 | 17 |
| Torque (kNm) | 30.4 | 29.2 | 26.6 | 25.1 |
| Power (kW) | 37.7 | 38.6 | 37.6 | 48.6 |

The tabulated results clearly show the reduced torque achieved by the use of the invention and furthermore demonstrate the marked superiority of the semicircular abutment (iii) in giving much reduced torque without any substantial increase in power consumption.

It will be observed that the elliptical abutment (iv) secured an even lower torque, because of the larger clearances, but at the expense of increased power consumption. This may be due in part to an increased rate of flash formation at the sides of the abutment, and performance could probably be improved by increasing the depth of the wheel groove, but it is not believed that the results obtained with the semicircular abutment (iii) could be bettered in this way.

We claim:

1. Continuous friction-actuated extrusion apparatus comprising a passageway extending from an entry end to an exit end between an arcuate first member and a second member in the form of a wheel having circumferential groove formed in its peripheral surface into which groove the first member projects, means for rotating the wheel in such a direction that those surfaces of the passageway constituted by the groove travel from the entry end towards the exit end, means for feeding metal into the passageway at the entry end, and at least one die orifice located in or adjacent to an abutment member extending across the passageway at the exit end thereof for extrusion of material from the passageway characterised by the fact that the abutment member instead of being large enough to block the end of the passageway is of substantially smaller cross-section than the passageway and leaves a substantial gap between the abutment member and the groove surface through which a substantial proportion of the metal will extrude in use to remain as a lining in the groove and to re-enter the passageway at the entry end.

2. Apparatus as claimed in claim 1 in which the abutment member has a cross-section with a peripheral length substantially less than the peripheral length of the effective groove cross-section.

3. Apparatus as claimed in claim 2 in which the abutment member is smoothly curved.

4. Continuous friction-actuated extrusion apparatus as claimed in claim 1 in which the abutment is substantially semi-circular in cross-section.

* * * * *